United States Patent [19]

Garrett

[11] Patent Number: 4,919,368

[45] Date of Patent: Apr. 24, 1990

[54] PORTABLE STAND WITH REMOVABLE BAR

[76] Inventor: Elmer E. Garrett, Box 40, Hut Hill Rd., Bridgewater, Conn. 06752

[21] Appl. No.: 329,389

[22] Filed: Mar. 27, 1989

[51] Int. Cl.[5] ..... F16L 3/00

[52] U.S. Cl. ..... 248/121; 248/167

[58] Field of Search ..... 248/121, 125, 158, 165, 248/166, 188.7, 176, 167, 435, 528; 211/189, 195, 203, 204, 196

[56] References Cited

U.S. PATENT DOCUMENTS

| | | | |
|---|---|---|---|
| 983,589 | 2/1911 | Wendt | 211/196 |
| 1,107,075 | 8/1914 | Karges | 211/196 X |
| 2,284,770 | 6/1942 | Scheuer | 211/196 X |
| 2,606,522 | 8/1952 | Harris | 248/167 X |
| 2,706,609 | 4/1955 | Sullivan | 248/167 |
| 3,507,402 | 4/1970 | Barbee | 211/204 |
| 4,146,204 | 3/1979 | Thalenfeld | 248/293 X |
| 4,288,052 | 9/1981 | Scott | 248/188.7 |
| 4,744,536 | 5/1988 | Bancalari | 248/125 |
| 4,763,866 | 8/1988 | Sinchok | 248/188.7 |
| 4,807,837 | 2/1989 | Gawlik | 248/125 |

*Primary Examiner*—J. Franklin Foss

[57] ABSTRACT

A portable stand with a horizontal telescopic bar removably mounted at the top of a vertical member. Two of four legs supporting the stand are hinged on the vertical member to reduce the space needed for storage. The vertical member is provided with a pocket for storing the telescoped bar when dismounted

1 Claim, 2 Drawing Sheets

PORTABLE STAND WITH REMOVABLE BAR

This invention is intended primarily for household use where there is often a need for folding newly laundered bedsheets. It has been found that this folding can be facilitated if a sheet is first draped and smoothed along its midline over a horizontal bar. By grasping the adjacent portions of the hanging material at one end of the sheet it can be folded and refolded to the size desired for storage.

A horizontal bar can obviously be supported in many ways. My method is unique in that the bar is supported by a light weight portable stand which can also be used for storing the bar when it is not in use. The stand can be used wherever desired as there is no need for attaching the bar to walls or fixtures. Also the stand is supported by movable legs which can be positioned against fixed legs to reduce the space needed for storage.

An understanding of the invention may be had by reference to the following drawings in which.

Figure 1:
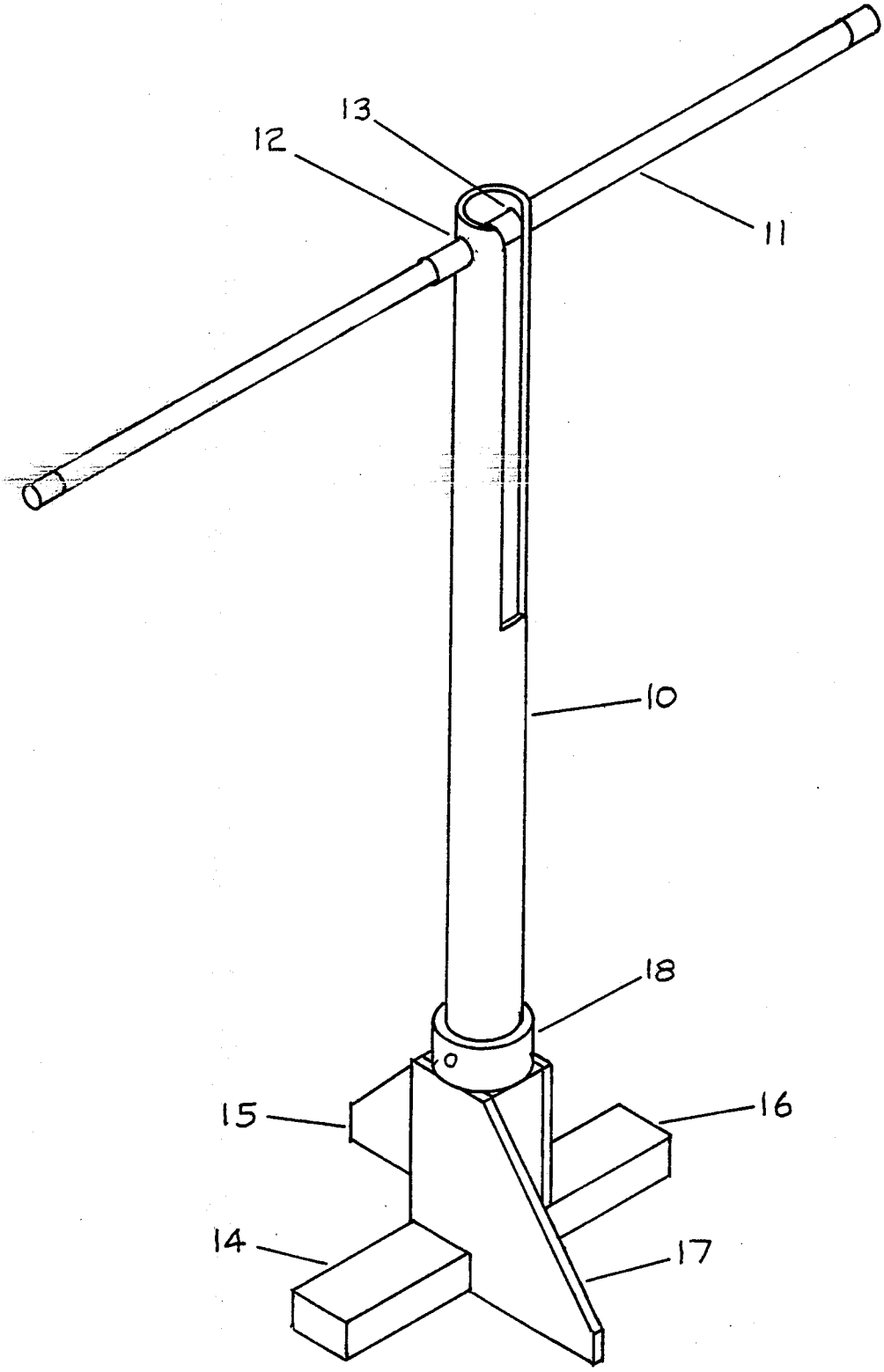
FIG. 1 is an overall view of the stand with the bar in place ready for use.

Referring to FIG. 1, the stand consists of a metal or plastic pipe 10 with bar 11 mounted at its upper end through holes 12 and 13. Pipe 10 is supported by legs 14, 15, 16 and 17. Legs 14 and 16 are contiguous and are attached rigidly to the pipe. Legs 15 and 17 also are contiguous but in a manner which makes them rotatable about pipe 10 through a 90 degree angle while being constrained axially by collar 18.

Bar 11 is of telescopic design. When ready for use it is extended to full length and positioned at about its midpoint in holes 12 and 13 of pipe 10. Dismounting for storage is accomplished by moving the small diameter end into the large diameter section by grasping both parts with the user's hands. The contracted bar is then withdrawn from holes 12 and 13.

Figure 3:
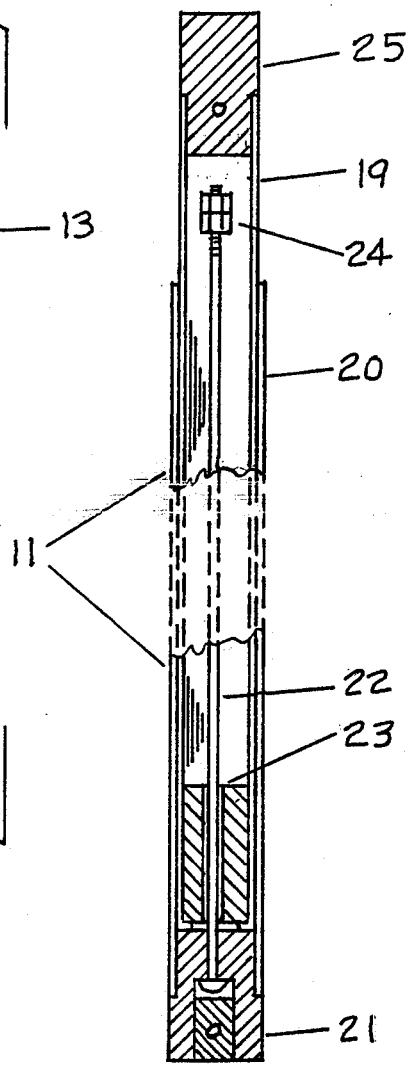
FIG. 3 is a sectional view of the bar telescoped for storage.

Referring to FIG. 3, bar 11 is shown in the telescoped position ready for storage. It consists of tube 20 containing slightly smaller diameter tube 19 which is free to slide in the bore of tube 20. Adapter 21 fixed in the end of tube 20 provides a mounting for rod 22 which is arranged to limit the extended position of tube 19. Tube 19 contains bushing 23 fixed firmly in the bore and provided with a central hole so it rides freely on rod 22. Nut 24 on the free end of rod 22 contacts bushing 23 at the outward limit of travel of tube 19. Bushing 25 firmly attached to the end of tube 19 protects the tube and rod ends.

Figure 2:
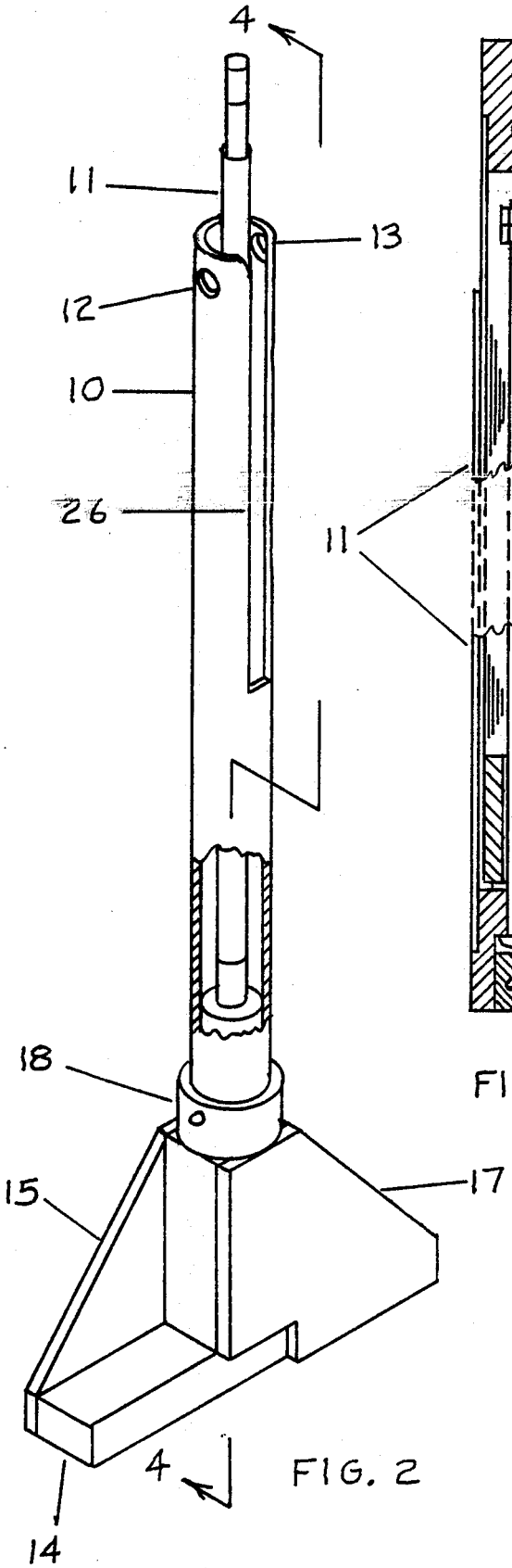
FIG. 2 is an overall view of the stand with the bar dismounted and positioned in the central pocket, also with the movable support legs moved against the fixed legs preparatory to placing the stand in storage.

FIG. 2 shows bar 11 positioned in the pocket of pipe 10. This placement is made easier by the provision of slot 26 in the wall of the pipe. This slot extends from the upper end to a position about half way to the bottom. the slot is slightly wider than the outside diameter of tube 20 thus making it possible to place the bar in the pocket without raising it to the upper open end. This helps to avoid contacting the workplace ceiling with the bar end.

Figure 4:
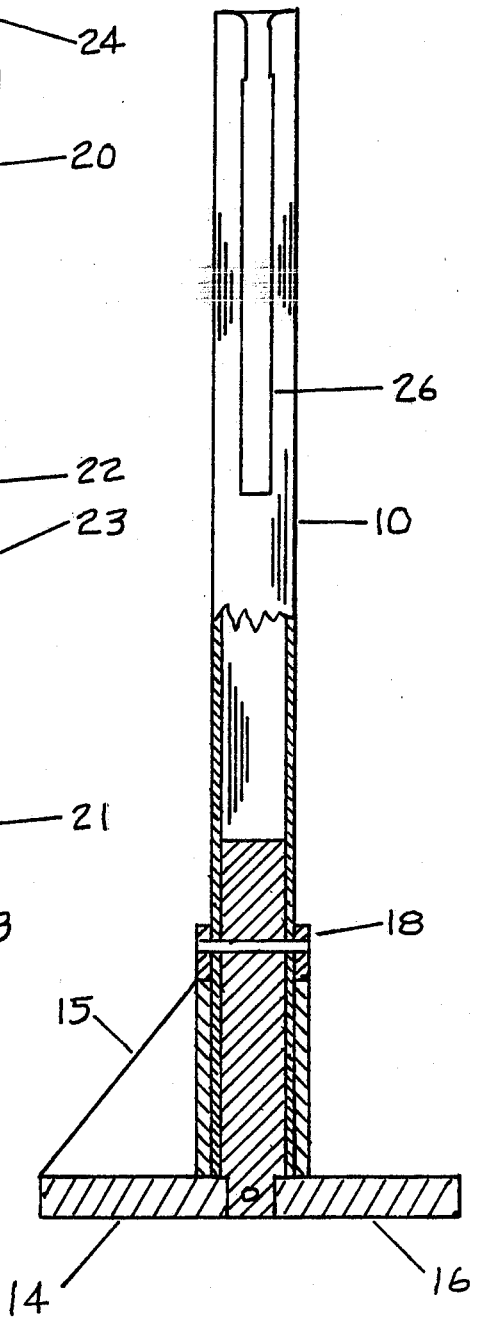
FIG. 4 is a partial sectional and exterior view of the stand taken along the line 4—4 shown on FIG. 2.

A refinement of the design of slot 26 is shown by FIG. 4. In this the width of the slot is decreased at the upper end to slightly less than the diameter of tube 20. This provides a detent action as bar 11 is tipped into the pocket and so reduces any tendency for the bar to lean out of the pocket.

What is claimed is:

1. A portable stand comprised of a vertical member with a horizontal bar removably mounted at the upper end and with said vertical member having a pocket for holding the removed bar, and a slot extending from the top axially part way to the bottom with said slot being of width sufficient to permit entry of the bar laterally into said pocket, and with the upper end of said slot being made narrower than the diameter of said bar to provide a detent action as said bar is moved laterally into said pocket, and with said vertical member being supported by four legs two of which are fixed to said vertical member and two of which are fixed axially to said vertical member and free to rotate together between positions normal to the fixed legs and positions parallel to said fixed legs.

* * * * *